US007338134B2

(12) United States Patent
Latham

(10) Patent No.: US 7,338,134 B2
(45) Date of Patent: Mar. 4, 2008

(54) FLIGHTING AND TOOL HOLDER

(75) Inventor: Winchester E. Latham, Avon, IN (US)

(73) Assignee: Keystone Engineering & Manufacturing Corp., Avon, IN (US)

( * ) Notice: Subject to any disclaimer, the term of this patent is extended or adjusted under 35 U.S.C. 154(b) by 81 days.

(21) Appl. No.: 11/287,526

(22) Filed: Nov. 23, 2005

(65) Prior Publication Data

US 2007/0114835 A1 May 24, 2007

(51) Int. Cl.
*E21C 35/18* (2006.01)

(52) U.S. Cl. ..... 299/87.1; 299/102

(58) Field of Classification Search ..... 299/87.1, 299/102–113

See application file for complete search history.

(56) References Cited

U.S. PATENT DOCUMENTS

| | | | |
|---|---|---|---|
| 2,949,946 | A | 8/1960 | Johnson |
| 3,146,961 | A | 9/1964 | Putman, Jr. |
| 3,321,145 | A | 5/1967 | Gorman |
| 3,489,042 | A | 1/1970 | Papp |
| 4,057,294 | A | 11/1977 | Krekeler |
| 4,480,873 | A | 11/1984 | Latham |
| 4,609,227 | A | 9/1986 | Wild et al. |
| 4,621,870 | A | 11/1986 | Levefelt |
| 4,693,518 | A | 9/1987 | Sulosky et al. |
| 4,936,516 | A | 6/1990 | Hench |
| 5,052,757 | A | 10/1991 | Latham |
| 5,056,243 | A | 10/1991 | Sprunger et al. |
| 5,186,575 | A | 2/1993 | Wirtgen |
| 5,322,351 | A | 6/1994 | Lent |
| 5,370,448 | A | 12/1994 | Sterwerf, Jr. |
| 5,417,131 | A | 5/1995 | Robertson |
| 5,904,408 | A | 5/1999 | Olson et al. |
| 6,183,170 | B1 | 2/2001 | Wald et al. |
| 6,523,768 | B2 | 2/2003 | Recker et al. |
| 2005/0098015 | A1 | 5/2005 | Latham |

FOREIGN PATENT DOCUMENTS

| | | | |
|---|---|---|---|
| GB | 1066251 | * | 4/1967 |

* cited by examiner

*Primary Examiner*—Sunil Singh
(74) *Attorney, Agent, or Firm*—Brinks Hofer Gilson & Lione

(57) ABSTRACT

A cutting drum for a scarifying milling machine includes a rotatable drum having a generally cylindrical outer surface, and a plurality of flight blocks mounted onto the outer surface of the drum, defining a helical flight extending therearound. Each of the flight blocks includes a slot and at least one pocket formed therein. Each slot is generally rectangular and adapted to receive a tool holder. Each flight block includes a tool holder, having a generally rectangular body, removably mounted within the slot. A retainer is positioned within each pocket. Each retainer includes a planar tapered surface that is parallel to and engages one side of the rectangular body of the tool holder within the slot of the flight block to secure the tool holder therein.

24 Claims, 10 Drawing Sheets

FLIGHTING AND TOOL HOLDER

BACKGROUND

1. Field of the Invention

The invention generally relates to rotary driven cylindrical cutters and scarifiers for use in earth-working, mining, or other in situ disintegration of hard materials. The invention is particularly directed to such rotary driven cylindrical cutters and scarifiers as incorporate means for feeding or excavating the material cut or mined away from its initial location generally to a second material carrier.

2. Background of the Invention

In general, roadway mining or planing equipment includes a rotary driven cylindrical comminuting drum which acts to scarify and to mine the top portion of the asphaltic road surface in situ. The rotary driven drum includes flighting on the drum which acts to collect and move the mined material toward the center of the drum where it can be removed. Often the mined material is then remixed with additional bituminous material and thereafter re-deposited as a newly formed smooth asphaltic surface.

In some prior art devices of this type, the flighting is itself formed from a plurality of cutting bit support members which are connected to the curved surface of the cutting drum by bolts which pass from the upper surface of the flighting downward into the drum to engage threaded openings in the drum. Alternatively, the bolts may pass through the surface of the drum to engage lock washers and threaded nuts on the interior of the drum. A plurality of the cutting bit supporting members can be arranged end-to-end so as to form a substantially continuous helical flighting. The top surface of the helical flighting is elevated above the curved surface of the drum. The top surface includes angled openings into which conventional cutting bits are received.

In use, the abrasive forces, which often include rather high value sudden shocks, are transmitted from the cutting bits into the supporting members and the bolts securing the supporting members to the smooth drum surface. The forces occasionally become large enough to shear the securing bolts, causing the machine to be stopped often for considerable lengths of time. The repair and replacement of the cutting bit supporting member damaged in this manner typically necessitates the use of an easy-out or similar removing tool in the field to remove the portions of the sheared bolts remaining in the drum. This is a time-consuming repair job which results in considerable expense to the road-mining machine operator.

In an attempt to avoid the problems presented by the bolt-secured supporting members, other roadway planing devices include a continuous flighting welded in place in helical fashion on the surface of the drum. A plurality of individual cutting bit support blocks are welded to the upper edge of the flighting. The support block includes a recess for receiving a cutting bit of a chisel cutter preferably having a tungsten carbide tip or the like.

In use, the cutting bits vibrate and otherwise move within the support block recess. Particularly in the presence of abrasive dust from the roadway mining operation, the vibration and movement of the cutting bits act to enlarge the recesses to such an extent that the cutting bit is no longer retained. It then becomes necessary to remove the old support block, usually with the aid of a cutting torch, and to weld a new support block in its place. Again, this repair job is difficult to do in the field and still achieve accurate alignment of the support block on the flighting section. Misalignment of the support block results in undesirable lateral forces on a new cutting bit which in turn results in very fast wear and ultimate failure of the replaced parts.

One solution for the above described problems is disclosed in U.S. patent application Ser. No. 10/705,709, filed Nov. 11, 2004, published May 12, 2005 (US 2005/0098015 A1), and entitled "Angular Tool And Holding Block", which is assigned to the assignee of the present application and is hereby incorporated by reference herein. The angular tool and holding block described in this published patent application provides a tool holder, a cutting bit, and a retainer for maintaining the tool holder at a prescribed position relative to the holding block. The tool holder includes a generally rectangular body portion, which can be square, dimensioned so that the tool holder body can be at least partially received in a slot formed in the holding block at a fixed orientation.

The tool holder also has a lower planar tapered portion-that is obliquely inclined to face laterally and upwardly. The lower planar tapered portion of the tool holder can be upwardly inclined at an angle of between about 1 degree and 5 degrees, and laterally inclined at an angle of between about 5 degrees and 15 degrees. The retainer includes a planar tapered surface inclined with respect to the line of action that intersects the perimeter surface. The planar tapered surface of the retainer can be inclined at an angle about equal to the lateral angle of inclination of the lower planar tapered portion of the tool holder. As the retainer is inserted into the opening, the planar tapered surface of the retainer contacts the lower planar tapered portion of the tool holder so that a downward and laterally inward force can be applied to the tool holder by the retainer to maintain the tool holder in the tool holder slot of the holding block.

This solution, however, requires a specially formed tool holder having a lower planar tapered portion. Therefore, standard rectangular or square tool holders cannot be used. Thus, there remains a need for a holder and holding block that retains the cutting bit at a prescribed position during any mining, cutting or other similar operation, which also enables quick replacement of the cutting bit or tool holder at the same location with a minimum of effort and time, and is capable of utilizing standard rectangular or square shaped tool holders.

SUMMARY

A cutting drum for a scarifying milling machine of the present invention includes a rotatable drum having a generally cylindrical outer surface, and a plurality of flight blocks mounted onto the outer surface of the drum. The flight blocks can be positioned onto the drum relative to one another such that the flight blocks define a helical flight extending around the outer surface of the drum.

In one aspect, each of the flight blocks includes a first side wall, a second side wall, and a top surface. The first and second side walls are generally parallel to one another and generally perpendicular to the drum. The top surfaces of the flight blocks define an outer periphery of the flight.

Each of the flight blocks includes a slot and at least one pocket formed therein. The slot is generally rectangular and adapted to receive a tool holder and includes first and second slot side walls, a bottom surface and a rear slot wall. The first and second slot side walls are generally parallel to one another and generally perpendicular to the rear slot wall. The rear slot wall is oriented at an angle relative to the first and second side walls of the flight block. The pocket intercepts the slot.

A generally rectangular shaped tool holder is received within the slot of each flight block. Each pocket is generally circular and includes a generally cylindrically shaped retainer positioned therein. Each retainer includes a planar tapered surface that is parallel to and engages one side of the rectangular body of the tool holder within the slot of the flight block to secure the tool holder therein.

In another aspect, each flight block includes a first hole extending from the second side wall to the rear slot wall and being oriented generally perpendicular to the rear slot wall. A threaded fastener extends through the hole and engages a threaded bore formed within the tool holder to further secure the tool holder within the slot of the flight block. Each pocket of each flight block includes a second hole extending from the pocket to the second side wall and being oriented generally perpendicular to the second side wall. A threaded fastener extends through the hole and engages a threaded bore formed within the retainer to pull the retainer within the pocket along a longitudinal axis through the second hole such that the planar tapered surface of the retainer pushes the tool holder against the rear slot wall and the side slot wall to keep the tool holder secured within the slot.

In still another aspect, the rear slot wall of each slot is oriented at an angle between about five degrees and about fifteen degrees relative to the first and second side walls of the flight block. The planar tapered surface of each retainer is oriented at an angle between about five degrees and about fifteen degrees relative to the longitudinal axis of the retainer. The planar tapered surface is oriented at an angle relative to the longitudinal axis of the retainer that matches the angle that the rear slot wall is oriented relative to the first and second side walls of the flight block.

In yet another aspect, the tool holder extends outward from the slot beyond the first side wall of the flight block a distance sufficient to protect at least a part of the flight block from abrasion and extend the life of the flight block.

In still another aspect, each flight block has a front surface and a rear surface. The flight blocks are positioned on the outer surface of the drum such that the first and second side walls are oriented generally perpendicular to a longitudinal axis of the drum. The front surface of each flight block is adjacent to and at least partially aligned with the rear surface of the next flight block, and each flight block is shifted axially along the drum relative to the previous flight block such that the flight blocks define a helical flight extending around the outer surface of the drum.

In yet another aspect, each tool holder has a recess formed therein, the recess being positioned at a distal end of the tool holder and adapted to receive a cutting tool. The tool holders project radially outward with respect to the drum and the recess within each tool holder is oriented at an angle with respect to a longitudinal axis of the tool holder such that the tool holder presents the cutting tool in a radially outward and rotationally forward direction with respect to the drum.

In still another aspect, the tool holders project radially outward and rotationally forward with respect to the drum and the recess within each tool holder is aligned with a longitudinal axis of the tool holder such that the tool holder presents the cutting tool in a radially outward and rotationally forward direction with respect to the drum.

DESCRIPTION OF THE DRAWINGS

The above, as well as other advantages of the present invention, will become readily apparent to those skilled in the art from the following detailed description of a preferred embodiment when considered in the light of the accompanying drawings.

DESCRIPTION OF THE EMBODIMENTS

Figure 1:
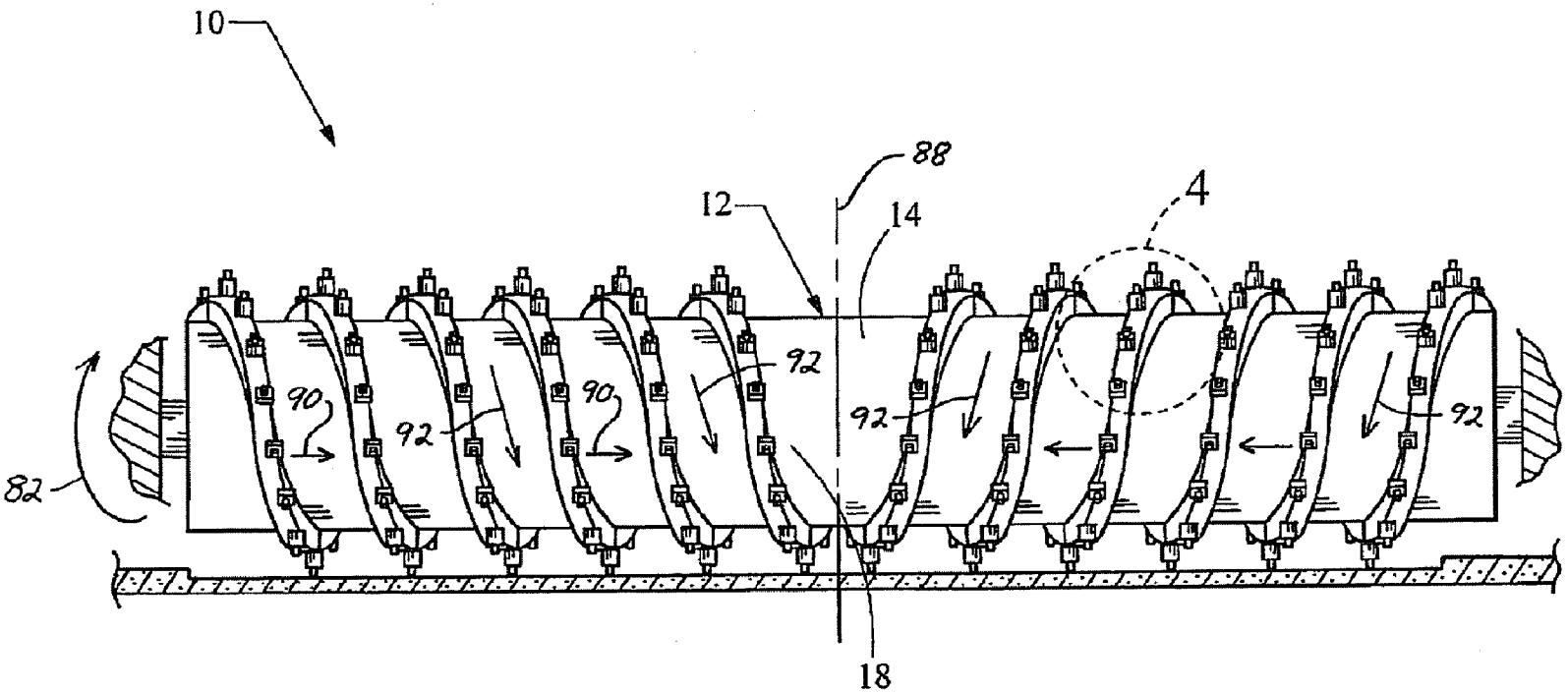
FIG. 1 is a front view of a cutting drum in accordance with the present invention.
Figure 2:
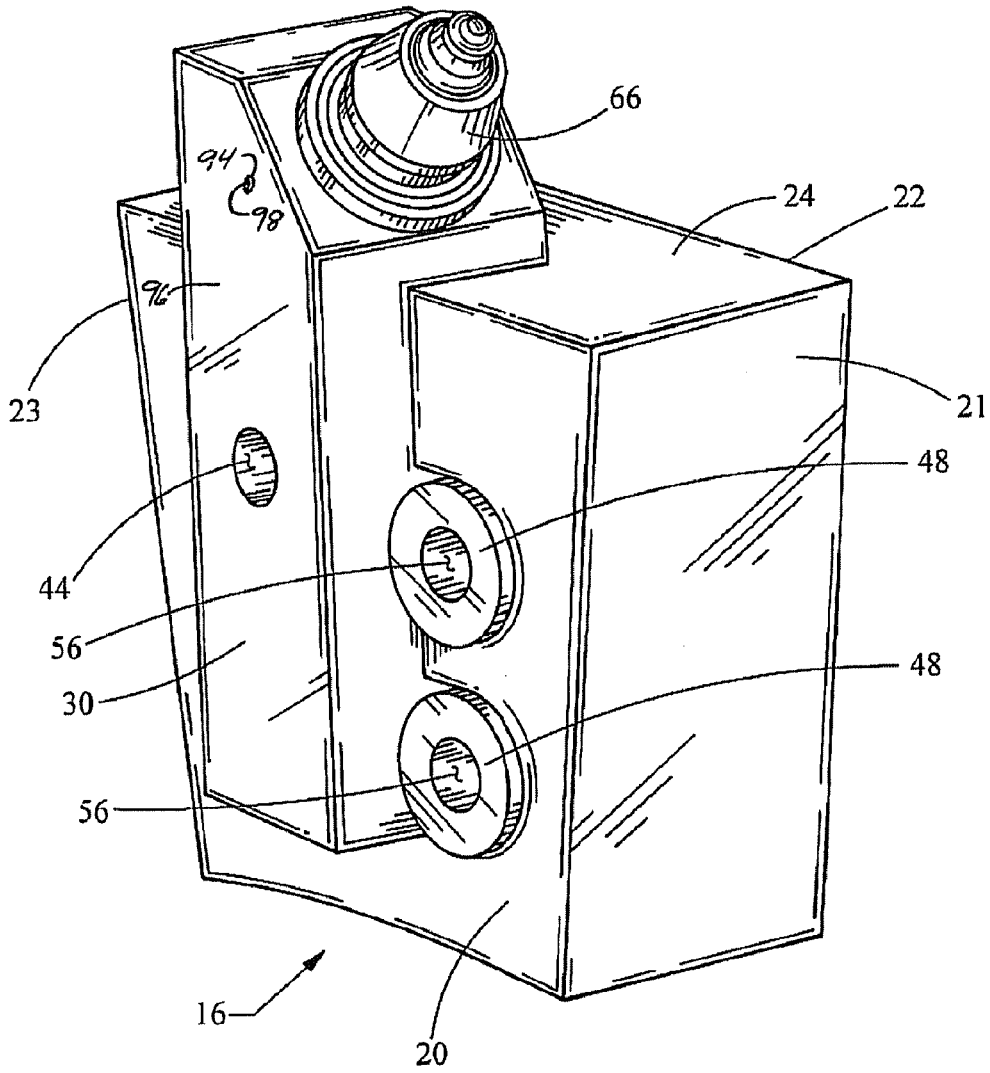
FIG. 2 is a perspective view of a flight block having a tool holder mounted therein.

Referring to FIG. 1, a cutting drum for a scarifying milling machine having features in accordance with the accompanying claims is shown generally at 10. The cutting drum 10 includes a rotatable drum 12 having a generally cylindrical outer surface 14. A plurality of flight blocks 16 are mounted onto the outer surface 14 of the drum 12. A single flight block 16 is shown in FIG. 2. The flight blocks 16 are positioned on the drum 12 relative to one another such that the flight blocks 16 define a helical flight 18 extending around the outer surface 14 of the drum 12, as shown in FIGS. 1, 3, and 4.

Figure 5:
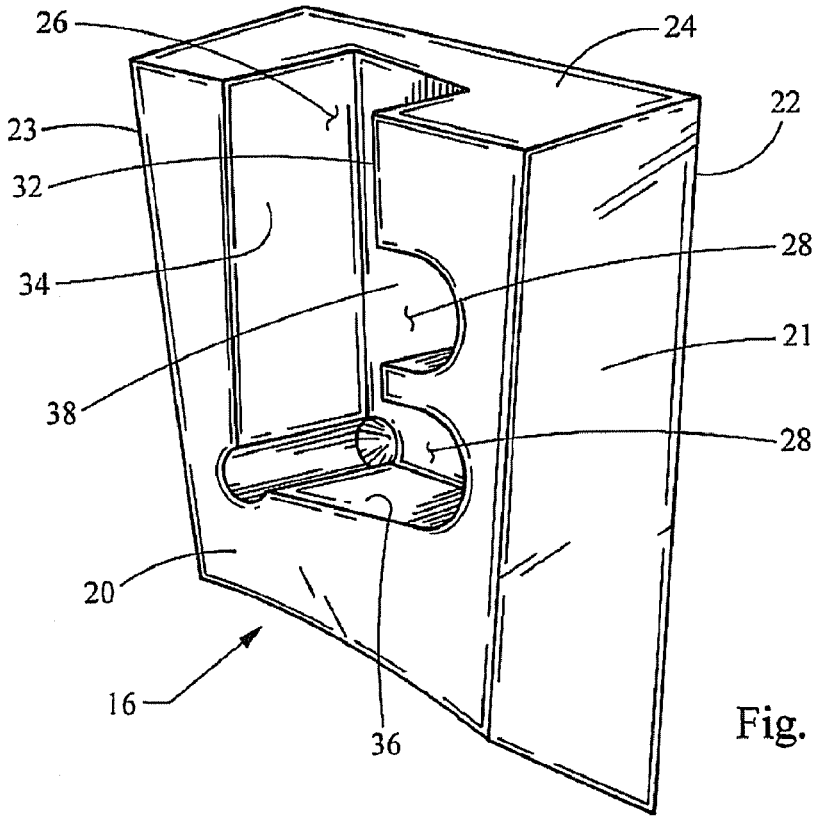
FIG. 5 is a perspective view of a flight block without a tool holder or retainers.
Figure 6:
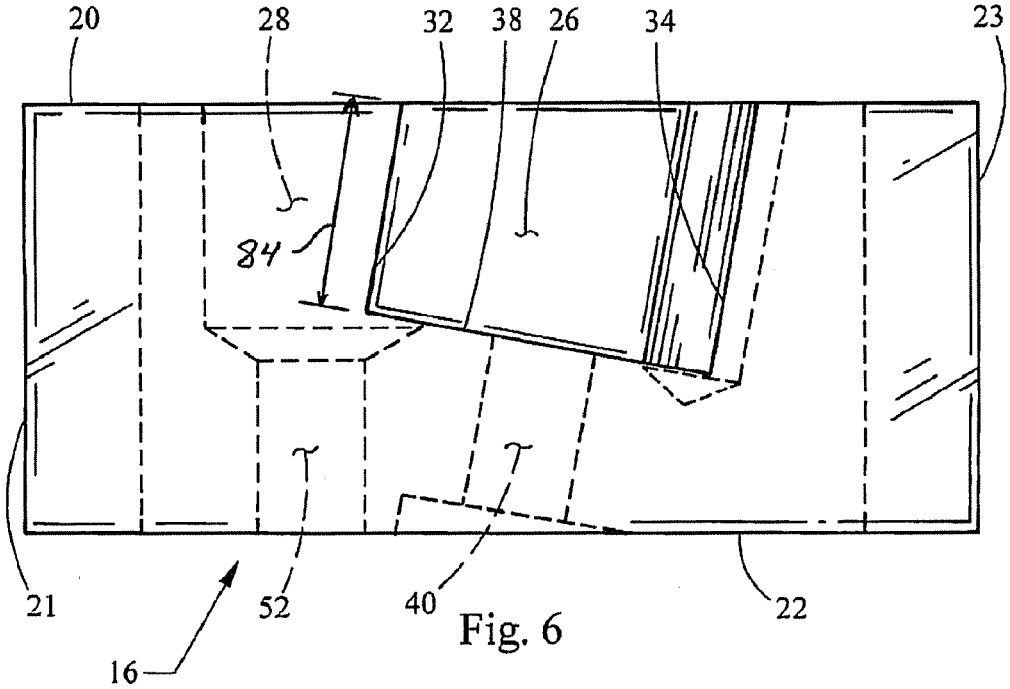
FIG. 6 is a top view of the flight block shown in FIG. 5.
Figure 7:
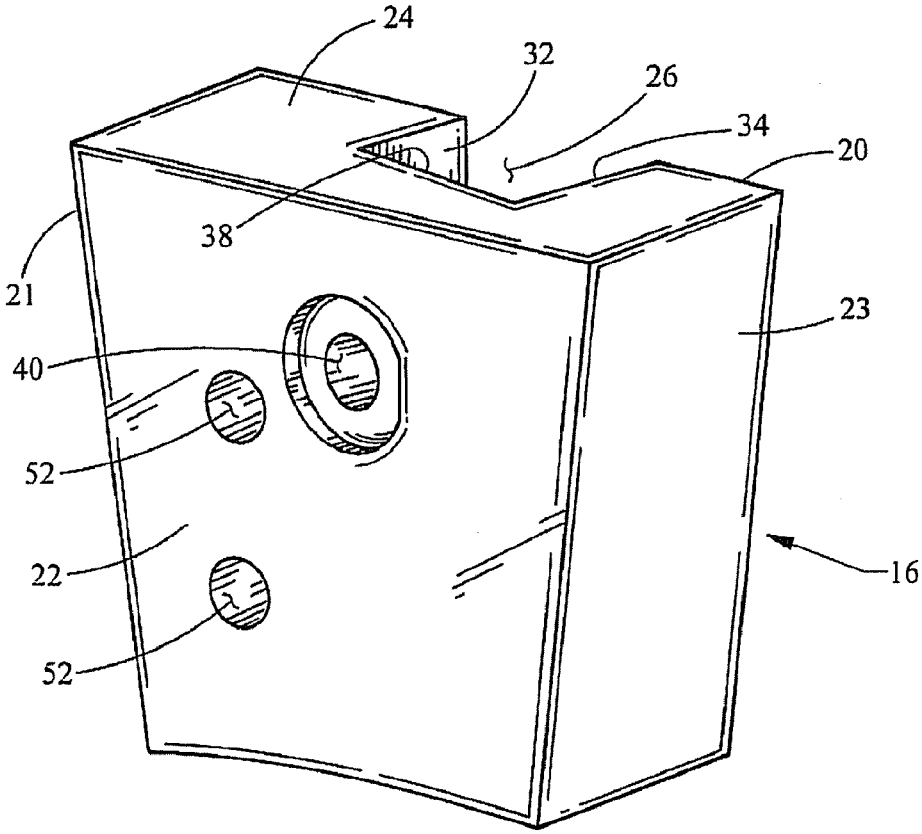
FIG. 7 is a rear view of the flight block shown in FIG. 5.
Figure 12:
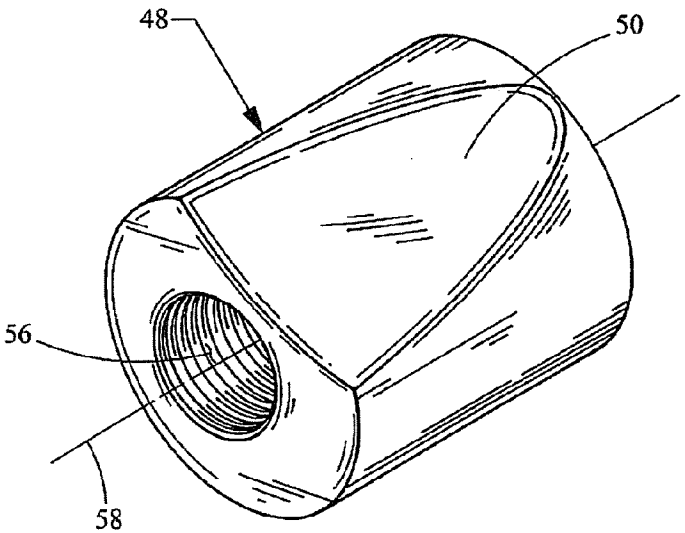
FIG. 12 is a perspective view of a retainer.

Referring to FIGS. 5, 6, and 7, each flight block 16 has a first side wall 20, a front surface 21, a second side wall 22, a rear surface 23, and a top surface 24. The first and second side walls 20, 22 are generally parallel to one another and generally perpendicular to the drum 12. The top surfaces 24 of the flight blocks 16 define an outer periphery of the flight 18.

Figure 3:
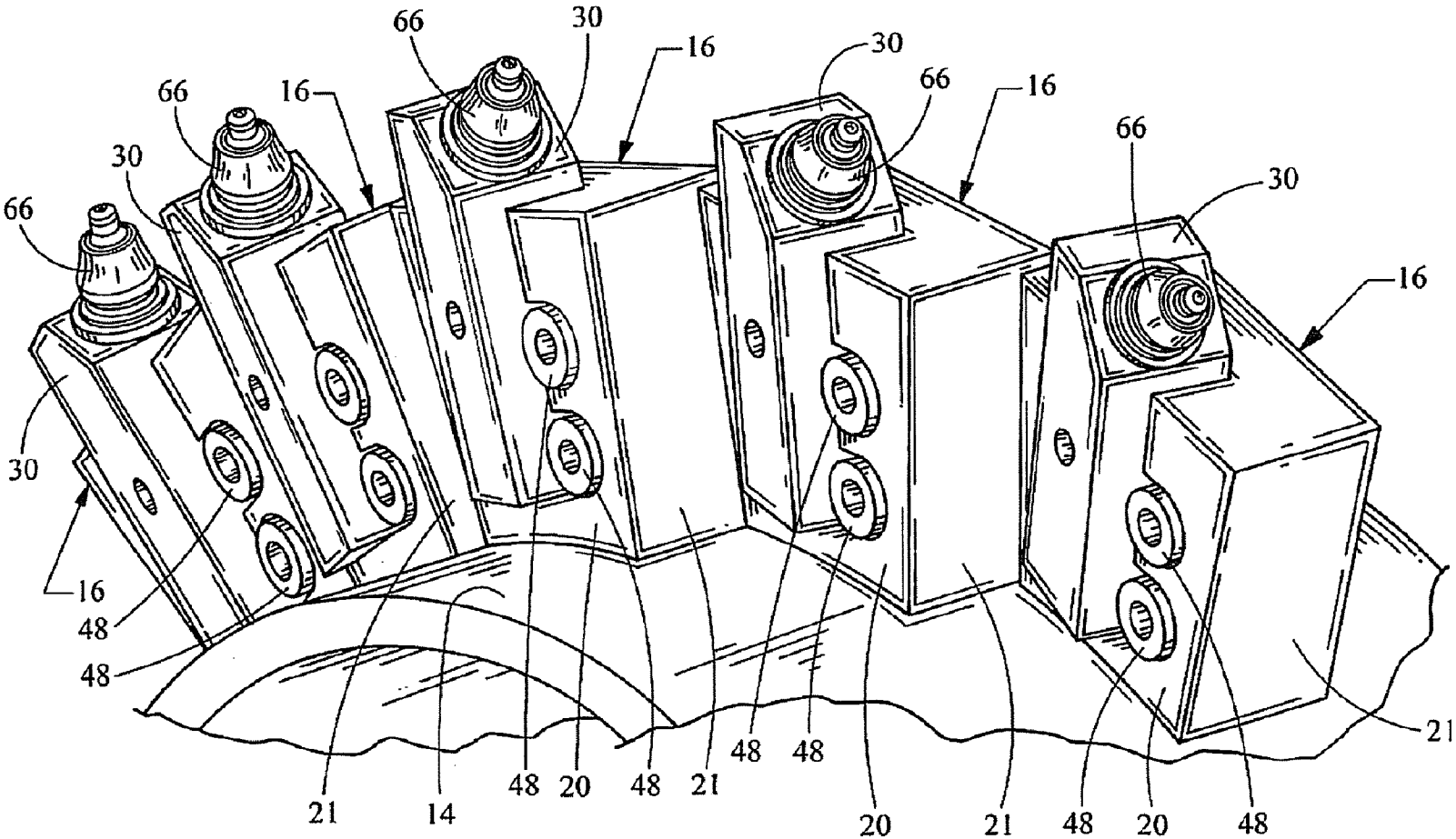
FIG. 3 is an enlarged view of a portion of FIG. 1 as indicated by the circled area labeled "FIG. 3" in FIG. 1.
Figure 4:
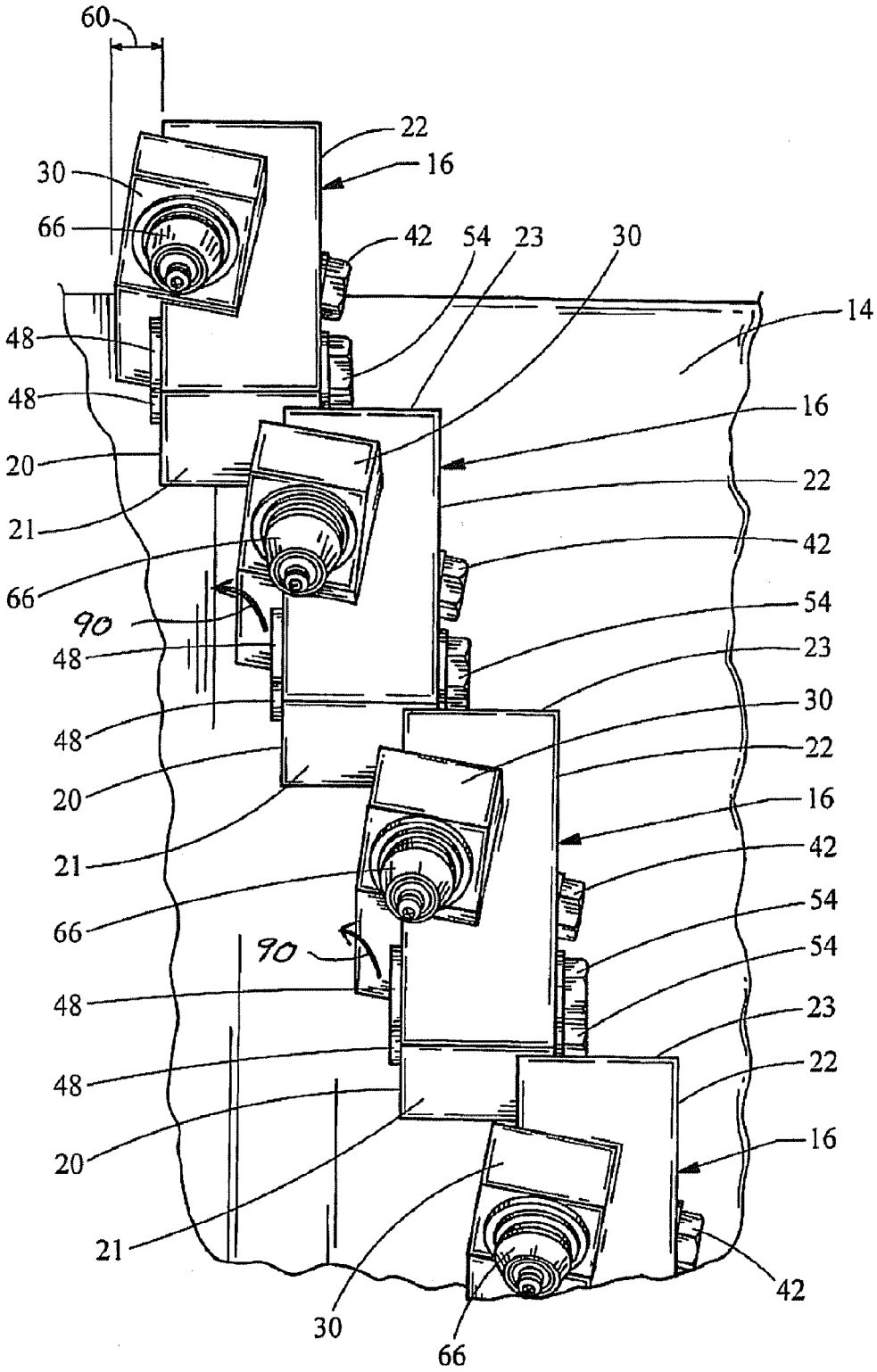
FIG. 4 is a top view of the flight blocks shown in FIG. 3.

Referring to FIGS. 1, 3, and 4, the flight blocks 16 are positioned on the outer surface 14 of the drum 12 such that the first and second side walls 20, 22 are oriented generally perpendicular to a longitudinal axis 15 of the drum 12. The front surface 21 of each flight block 16 is adjacent to, and at least partially aligned with, the rear surface 23 of the next flight block 16, in an over-lapping manner. Each flight block 16 is shifted axially along the drum 12 relative to the previous flight block 16 such that the flight blocks 16 define a helical flight 18 extending around the outer surface 14 of the drum 12.

Referring again to FIGS. 5, 6, and 7, each of the flight blocks 16 include a slot 26 and at least one pocket 28 formed therein and intercepting the slot 26. As illustrated in the Figures, the flight block 16 includes two such pockets 28 that intercept the slot 26. The slot 26 is generally rectangular and is adapted to receive a tool holder 30. The tool holder 30 is shown generally in FIG. 8. Each tool holder 30 has a recess 62 formed therein. The recess 62 is positioned at a distal end 64 of the tool holder 30 and is adapted to receive a cutting tool 66.

The slot 26 includes first and second slot side walls 32, 34, a bottom surface 36, and a rear slot wall 38. The first and second slot side walls 32, 34 are generally parallel to one another and generally perpendicular to the rear slot wall 38. The rear slot wall 38 is oriented at an angle relative to the first and second side walls 20, 22 of the flight block 16. A tool holder 30 is removably mounted within the slot 26 of each flight block 16. Each tool holder 30 has a generally rectangular body that is dimensioned to fit closely within the slots 26.

Figure 9:
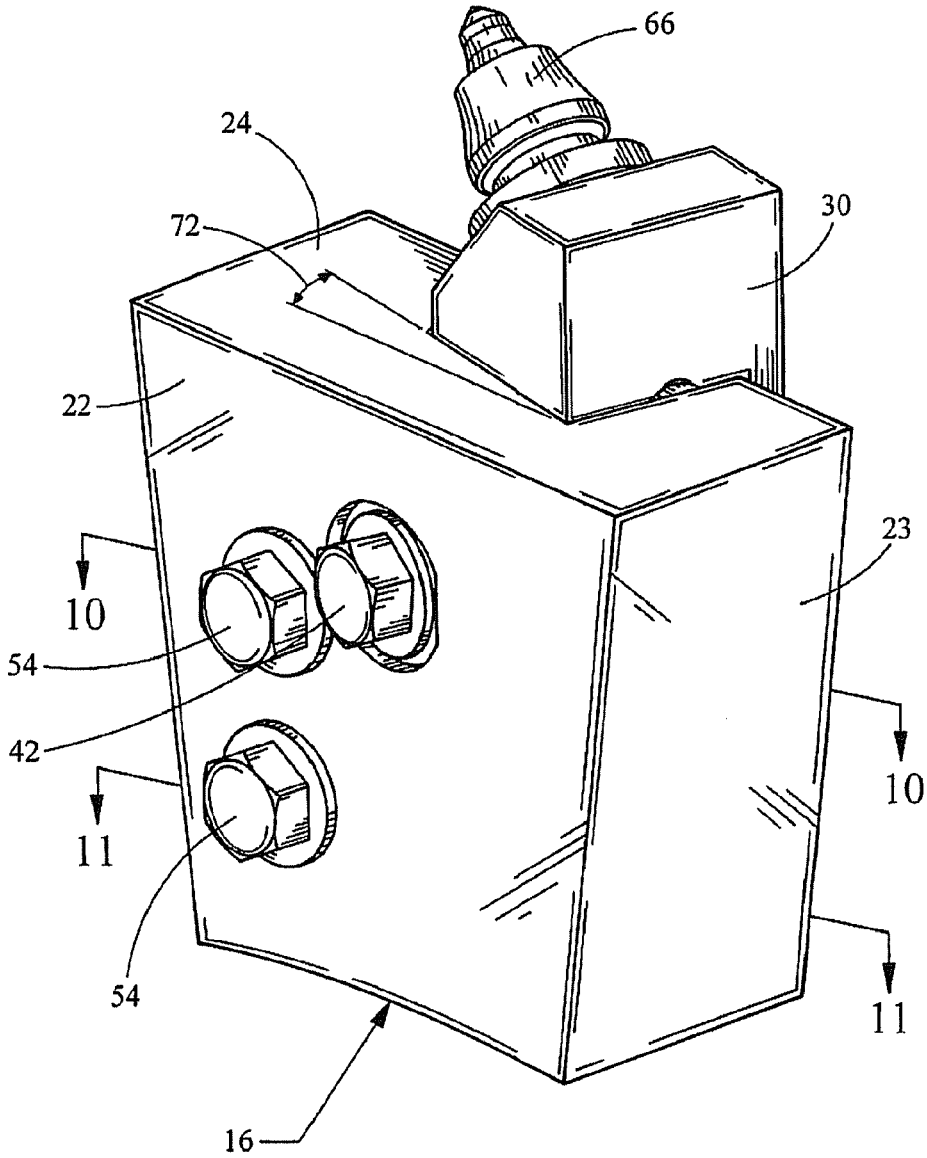
FIG. 9 is a rear perspective view of a flight block having a tool holder mounted therein.
Figure 10:
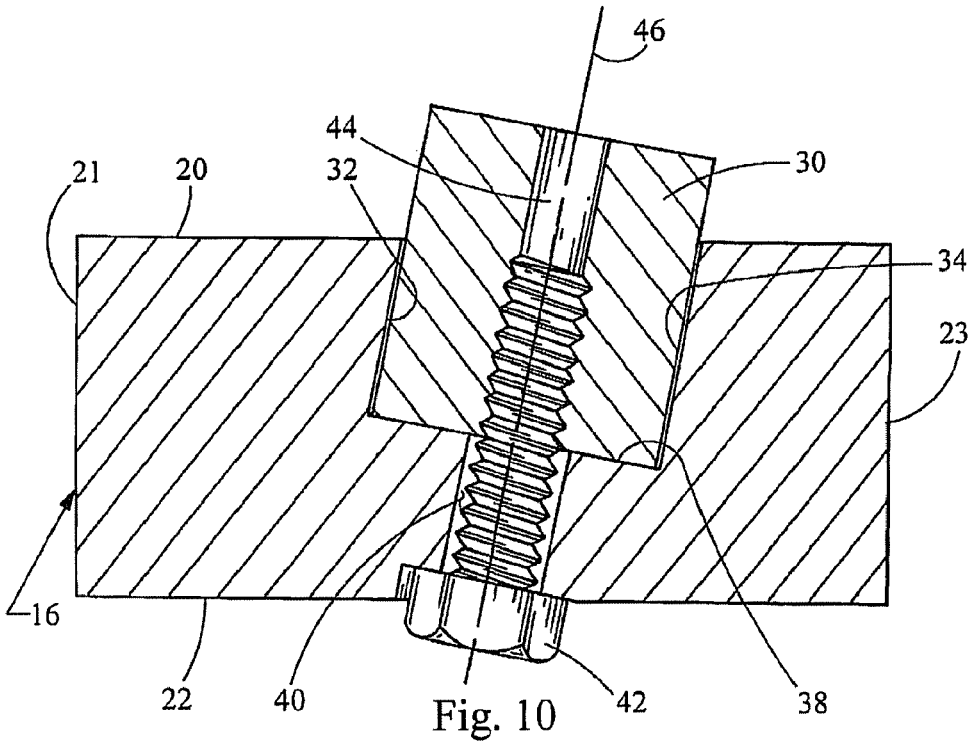
FIG. 10 is a sectional view taken along lines 10-10 of FIG. 9.
Figure 11:
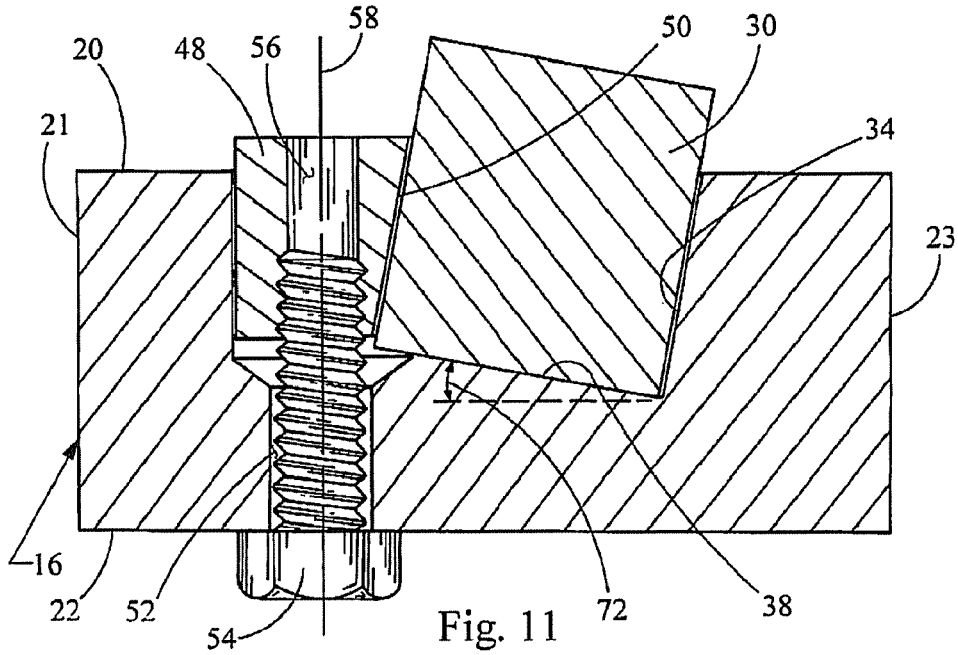
FIG. 11 is a sectional view taken along lines 11-11 of FIG. 9.

Referring to FIGS. 6, 9, and 10, each flight block 16 includes a first hole 40 formed therein that extends from the second side wall 22 to the rear slot wall 38 and is oriented generally perpendicular to the rear slot wall 38. A threaded fastener 42 extends through the hole 40 and engages a threaded bore 44 formed within the tool holder 30 to secure the tool holder 30 within the slot 26 of the flight block 16. The hole 40, and therefore the longitudinal axis 46 of the threaded fastener 42 is oriented generally perpendicular to the rear slot wall 38, such that the engagement between the threaded fastener 42 and the tool holder 30 acts to pull and retain the tool holder 30 against the rear slot wall 38.

Referring to FIGS. 2, 9,11, and 12, one retainer 48 is positioned within each pocket 28 of each flight block 16. As shown, each pocket 28 is generally circular and each retainer 48 is generally cylindrically shaped having a longitudinal axis 58.

Each retainer 48 includes a planar tapered surface 50 that is oriented at an angle relative to the longitudinal axis 58 of the retainer 48. The planar tapered surface 50 is parallel to and engages one side of the rectangular body of the tool holder 30 within the slot 26 of the flight block 16 to secure the tool holder 30 therein. Each pocket 28 includes a second hole 52 formed therein that extends from the pocket 28 to the second side wall 22 and is oriented generally perpendicular to the second side wall 22. A threaded fastener 54 extends through each second hole and engages a threaded bore 56 formed within the retainer 48.

The hole 52, and therefore the longitudinal axis of the threaded fastener 54 is oriented generally perpendicular to the second side wall 22, coincident with the longitudinal axis 58 of the retainer 48, such that the engagement between the threaded fastener 54 and the tool holder retainer 48 acts to pull and retain the retainer 48 into the pocket 28. The resultant force that the planar tapered surface 50 of the retainer 48 exerts against the tool holder 30 acts to pull the tool holder 30 into the slot 26 against the rear slot wall 38, and at the same time, pushes the tool holder 30 against the second slot side wall 34.

As shown, the rear slot wall 38 of each slot 26 is oriented at an angle 72 between about five degrees and about fifteen degrees relative to the first and second side walls 20, 22 of the flight block 16. The planar tapered surface 50 of the retainer 48 is oriented at a corresponding angle of between about five degrees and about fifteen degrees relative to the longitudinal axis 58 of the retainer 48. This allows the tool holder 30 to be generally rectangular in shape such that standard tool holders can be used rather than using a specially manufactured tool holder.

Referring to FIG. 4, the tool holder 30 extends outward from the slot 26 beyond the first side wall 20 of the flight block 16 a distance 60 sufficient to protect at least a part of the flight block 16 from abrasion, and to extend the life of the flight block 16. Further, because the tool holder 30 is held at an angle relative to the first side wall 20, debris is directed to the side of the flight block 16 as indicated by arrows 90.

Referring again to FIG. 1, the cutting drum 10 rotates as indicated by arrow 82. The flight 18 is adapted to draw debris to the center 88 of the drum 10. The flight blocks 16 positioned from the center 88 to the right side of the drum 10 are adapted to hold the tool holders 30 such that the tool holders 30 face the center of the drum 10, as shown in FIGS. 2, 3, and 4. The flight blocks 16 positioned from the center 88 to the left side of the drum 10 are mirror images of the flight blocks 16 positioned to the right side of the drum 19, and are adapted to hold the tool holders 30 such that the tool holders 30 extend from the first side wall 20, facing the center 88 of the drum 10. The angle of the tool holders 30 within the flight blocks 16 causes debris to be deflected toward the center 88 of the cutting drum 10, as indicated by arrows 90 in FIGS. 1 and 4. Thus, as the cutting drum 10 rotates, the debris is carried to the center of the drum 10 by the helical flight 18, as shown by arrows 92 in FIG. 1.

Figure 8:
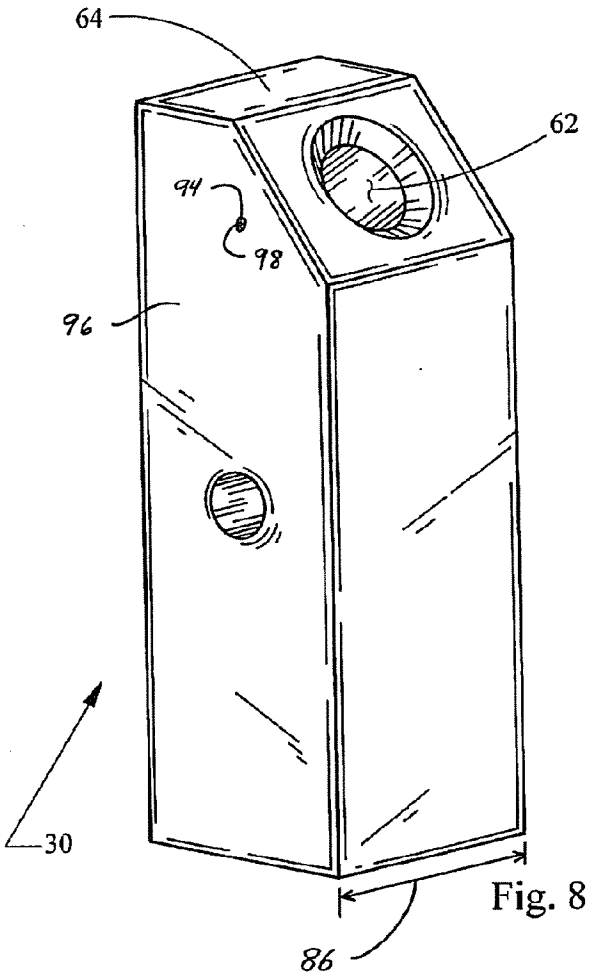
FIG. 8 is a perspective view of a tool holder.

Referring to FIG. 6, the first slot side wall 32 has a depth, as indicated by reference numeral 84. Referring to FIG. 8, the tool holder 30 has a width, as indicated by reference numeral 86. Preferably, the depth 84 is approximately equal to one half the width 86 of the tool holder 30. Therefore, a common tool holder 30 can be used, wherein the cutting tool 66 is roughly aligned with the first side wall 20 of the flight block 16, when the tool holder 30 is placed into either a right side or left side flight block 16. This allows a common tool holder 30 to be used in the flight blocks 16 positioned to the left and to the right of center 88 on the drum 10. Furthermore, with the cutting tool 66 roughly aligned with the first side wall 20 of the flight block 16, the debris will be pushed away to the side of the flight block 16 rather than directly onto the top surface 24 of the flight block 16.

Figure 13:
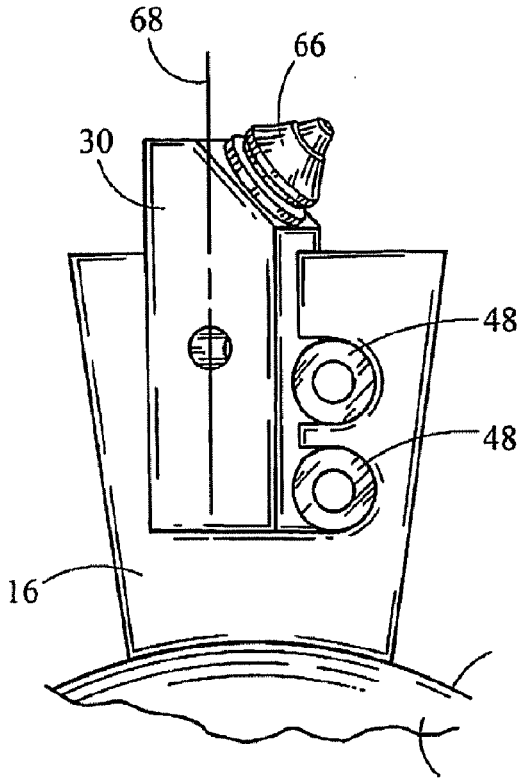
FIG. 13 is a side view of a flight block wherein the tool holder is held generally perpendicular to the drum and the tool holder presents the tool in a radially outward and rotationally forward orientation.
Figure 14:
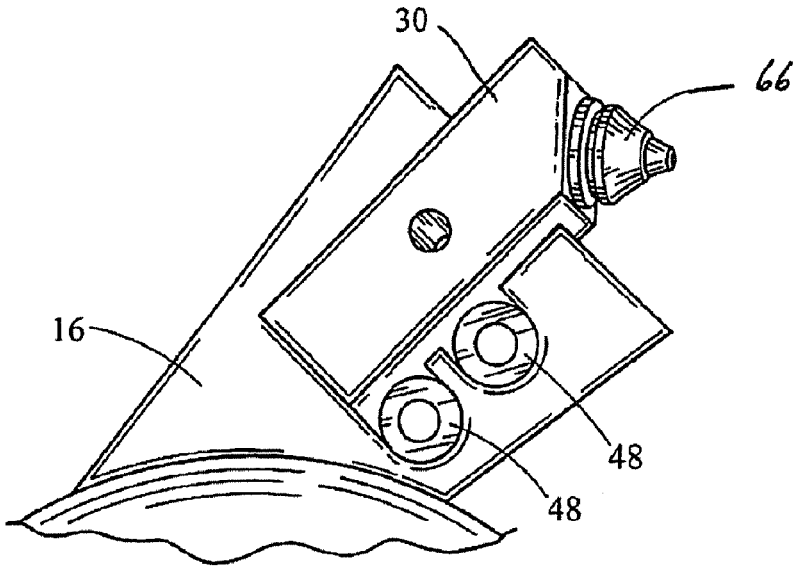
FIG. 14 is a side view of a flight block wherein the tool holder is held oriented radially outward and rotationally forward with respect to the drum such that the tool is presented in a radially outward and rotationally forward orientation.

Referring to FIG. 13, in one embodiment, the flight blocks 16 hold the tool holders 30 such that the tool holders project radially outward with respect to the drum 12. The recess 62 within each tool holder 30 is oriented at an angle with respect to a longitudinal axis 68 of the tool holder 30. In this way, the tool holder 30 presents the cutting tool 66 in a radially outward and rotationally forward direction with respect to the drum 12. Alternatively, as shown in FIG. 14, the flight blocks 16 hold the tool holders 30 such that the tool holders 30 themselves project radially outward and rotationally forward with respect to the drum 12.

Referring again to FIGS. 2 and 8, the tool holder 30 includes a threaded bore 94 formed therein. The threaded bore 94 extends from the recess 62 to an outer surface 96 of the tool holder 30. A threaded set screw 98 is positioned within the threaded bore 94 and is adapted to selectively engage a cutting tool 66 positioned within the recess 62 to secure the cutting tool 66 therein. The tool holder 30 may include more than one set screw 98, and the threaded bore 94 and set screw 98 may be positioned on either side of the tool holder 30 or on the rear of the tool holder 30.

In accordance with the provisions of the patent statutes, the present invention has been described in what is considered to represent its preferred embodiment. However, it should be noted that the invention can be practiced otherwise than as specifically illustrated and described.

What is claimed is:

1. A cuffing drum for a scarifying milling machine comprising:

a rotatable drum having a generally cylindrical outer surface;

a plurality of flight blocks mounted onto the outer surface of the drum, the flight blocks being positioned onto the drum relative to one another such that the flight blocks define a helical flight extending around the outer surface of the drum;

each of the flight blocks including a first side wall, a second side wall, and a top surface, the first and second side walls being generally parallel to one another and generally perpendicular to the drum, the top surfaces of the flight blocks defining an outer periphery of the flight;

each of the flight blocks including a slot and at least one pocket formed therein, each slot being generally rectangular and adapted to receive a tool holder and including first and second slot side walls, a bottom surface and a rear slot wall, the first and second slot side walls being generally parallel to one another and generally perpendicular to the rear slot wall, and the rear slot wall being oriented at an angle relative to the first and second side walls of the flight block, the at least one pocket intercepting the slot;

a plurality of tool holders having a generally rectangular body dimensioned to be received within the slot of a flight block, one tool holder being removably mounted within the slot of each flight block;

a plurality of retainers, one retainer being positioned within each pocket of each flight block, each retainer including a planar laterally tapered surface that is parallel to and engages one side of the rectangular body of the tool holder within the slot of the flight block to secure the tool holder therein.

2. The cutting drum of claim 1 wherein, each flight block includes a first hole formed therein, the first hole extending from the second side wall to the rear slot wall and being oriented generally perpendicular to the rear slot wall, a threaded fastener extending through the hole and engaging a threaded bore formed within the tool holder to further secure the tool holder within the slot of the flight block.

3. The cutting drum of claim 2 wherein, each pocket of each flight block includes a second hole formed therein, the second hole extending from the pocket to the second side wall and being oriented generally perpendicular to the second side wall, a threaded fastener extending through the hole and engaging a threaded bore formed within the retainer to pull the retainer within the pocket along a longitudinal axis through the second hole such that the planar laterally tapered surface of the retainer pushes the tool holder against the rear slot wall and the side slot wall to keep the tool holder secured within the slot.

4. The cutting drum of claim 3 wherein, each pocket is generally circular and each retainer is generally cylindrically shaped having a longitudinal axis aligned with the longitudinal axis of the second hole.

5. The cutting drum of claim 4, wherein the rear slot wall of each slot of each flight block is oriented at an angle between about five degrees and about fifteen degrees relative to the first and second side walls of the flight block.

6. The cutting drum of claim 5 wherein, the planar laterally tapered surface of each retainer is oriented at an angle between about five degrees and about fifteen degrees relative to the longitudinal axis of the retainer.

7. The cutting drum of claim 6 wherein the planar laterally tapered surface of each retainer is oriented at an angle relative to the longitudinal axis of the retainer that matches the angle that the rear slot wall of each slot of each flight block is oriented relative to the first and second side walls of the flight block.

8. The cutting drum of claim 1 wherein the tool holder extends outward from the slot beyond the first side wall of the flight block a distance sufficient to protect at least a part of the flight block from abrasion so as to extend the life of the flight block.

9. The cutting drum of claim 1 wherein each flight block has a front surface and a rear surface, the flight blocks being positioned on the outer surface of the drum such that the first and second side walls are oriented generally perpendicular to a longitudinal axis of the drum, the front surface of each flight block is adjacent to and at least partially aligned with the rear surface of the next flight block, and each flight block is shifted axially along the drum relative to the previous flight block such that the flight blocks define a helical flight extending around the outer surface of the drum.

10. The cutting drum of claim 1, wherein each tool holder has a recess formed therein, the recess being positioned at a distal end of the tool holder and adapted to receive a cutting tool.

11. The cutting drum of claim 10, wherein the tool holders project radially outward with respect to the drum and the recess within each tool holder is oriented at an angle with respect to a longitudinal axis of the tool holder such that the tool holder presents the cutting tool in a radially outward and rotationally forward direction with respect to the drum.

12. The cutting drum of claim 10, wherein the tool holders project radially outward and rotationally forward with respect to the drum and the recess within each tool holder is aligned with a longitudinal axis of the tool holder such that the tool holder presents the cutting tool in a radially outward and rotationally forward direction with respect to the drum.

13. A flight block adapted to be mounted onto a cutting drum for a scarifying milling machine comprising:

a first side wall, a second side wall, and a top surface, the first and second side walls being generally parallel to one another and generally perpendicular to the top surface;

a slot formed within the first side wall and extending through the top surface, the slot being generally rectangular and adapted to receive a tool holder and including first and second slot side walls, a bottom surface and a rear slot wall, the first and second slot side walls being generally parallel to one another and generally perpendicular to the rear slot wall, and the rear slot wall being oriented at an angle relative to the first and second side walls;

at least one pocket formed within the first side wall and intercepting the slot;

a tool holder having a generally rectangular body dimensioned to be received within the slot and being removably mounted within the slot;

a retainer positioned within each pocket, each retainer including a planar laterally tapered surface that is parallel to and engages one side of the rectangular body of the tool holder to secure the tool holder within the slot.

14. The flight block of claim 13 further including a first hole formed therein, the first hole extending from the second side wall to the rear slot wall and being oriented generally perpendicular to the rear slot wall, a threaded fastener extending through the hole and engaging a threaded bore formed within the tool holder to further secure the tool holder within the slot.

15. The flight block of claim 14 wherein, each pocket includes a second hole formed therein, the second hole extending from the pocket to the second side wall and being oriented generally perpendicular to the second side wall, a threaded fastener extending through the hole and engaging a threaded bore formed within the retainer to pull the retainer within the pocket along a longitudinal axis through the second hole such that the planar laterally tapered surface of the retainer pushes the tool holder against the rear slot wall and the side slot wall to keep the tool holder secured within the slot.

16. The flight block of claim 15 wherein, each pocket is generally circular and each retainer is generally cylindrically shaped having a longitudinal axis aligned with the longitudinal axis of the second hole.

17. The flight block of claim 16, wherein the rear slot wall of the slot is oriented at an angle between about five degrees and about fifteen degrees relative to the first and second side walls of the flight block.

18. The flight block of claim 17 wherein, the planar laterally tapered surface of each retainer is oriented at an angle between about five degrees and about fifteen degrees relative to the longitudinal axis of the retainer.

19. The flight block of claim 18 wherein the planar laterally tapered surface of each retainer is oriented at an angle relative to the longitudinal axis of the retainer that matches the angle that the rear slot wall is oriented relative to the first and second side walls.

20. The flight block of claim 13 wherein the tool holder extends outward from the slot beyond the first side wall a distance sufficient to protect at leest a part of the flight block from abrasion so as to extend the life of the flight block.

21. The flight block of claim 13, wherein the tool holder has a recess formed therein, the recess being positioned at a distal end of the tool holder and adapted to receive a cutting tool.

22. The flight block of claim 21, wherein the tool holder projects outward generally perpendicular to the top surface of the flight block, and the recess within the tool holder is oriented at an angle with respect to a longitudinal axis of the tool holder such that when the flight block is mounted onto a cutting drum, the tool holder presents the cutting tool in a radially outward and rotationally forward direction with respect to the drum.

23. The flight block of claim 21, wherein the tool holder projects outward at and angle relative to the top surface of the flight block and the recess is aligned with a longitudinal axis of the tool holder such that when the flight block is mounted onto a cutting drum, the tool holder presents the cutting tool in a radially outward and rotationally forward direction with respect to the drum.

24. A flight block adapted to be mounted onto a cutting drum for a scarifying milling machine comprising:

a first side wall, a second side wall, and a top surface, the first and second side walls being generally parallel to one another and generally perpendicular to the top surface;

a slot formed within the first side wall and extending through the top surface, the slot being generally rectangular and adapted to receive a tool holder and including first and second slot side walls, a bottom surface and a rear slot wall, the first and second slot side walls being generally parallel to one another and generally perpendicular to the rear slot wall, and the rear slot wall being oriented at an angle relative to the first and second side walls;

at least two pockets formed within the first side wall and oriented substantially perpendicular to the first wall and intercepting the slot;

a tool holder having a generally rectangular body dimensioned to be received within the slot and being removably mounted within the slot;

a retainer positioned within each pocket, each retainer including a planar laterally tapered surface that is parallel to and engages one side of the rectangular body of the tool holder to secure the tool holder within the slot.

* * * * *

UNITED STATES PATENT AND TRADEMARK OFFICE

CERTIFICATE OF CORRECTION

PATENT NO. : 7,338,134 B2
APPLICATION NO. : 11/287526
DATED : March 4, 2008
INVENTOR(S) : Winchester E. Latham It is certified that error appears in the above-identified patent and that said Letters Patent is hereby corrected as shown below:

Column 6
Line 64, delete “cuffing” and insert --cutting--.

Column 9
Line 27, delete “leest” and insert --least--.

Column 10
Line 2, delete “and” and insert --an--.

Signed and Sealed this

Third Day of June, 2008

JON W. DUDAS
*Director of the United States Patent and Trademark Office*